US005575558A

United States Patent [19]

Coushaine et al.

[11] Patent Number: 5,575,558

[45] Date of Patent: Nov. 19, 1996

[54] MINIATURE DISCHARGE LAMP TUBE HOLDER

[75] Inventors: Charles M. Coushaine, Rindge; Robert J. Schmitt, Jr., Raymond; Frank P. Kace, Jr., Antrim, all of N.H.

[73] Assignee: Osram Sylvania Inc., Danvers, Mass.

[21] Appl. No.: 338,052

[22] Filed: Nov. 10, 1994

[51] Int. Cl.[6] ..... F21V 21/00

[52] U.S. Cl. ..... 362/396; 362/217; 362/263; 248/50; 248/74.2; 248/302

[58] Field of Search ..... 248/218.1, 218.2, 248/302, 316.1, 316.7, 50, 74.2, 224.7, 224.8; 362/217, 225, 306, 396, 260, 263; 174/138 H; 40/545

[56] References Cited

U.S. PATENT DOCUMENTS

| | | | |
|---|---|---|---|
| 2,446,461 | 8/1948 | Diver | 362/217 |
| 2,545,416 | 3/1951 | Staaf | 248/50 |
| 2,565,635 | 8/1951 | Thuernau | 40/545 |
| 2,629,814 | 2/1953 | Brown | 362/225 |
| 2,885,538 | 5/1959 | Mahon et al. | 362/217 |
| 3,135,488 | 6/1964 | Leonard | 362/217 |
| 3,253,084 | 5/1966 | Taylor | 248/74.2 |
| 4,514,793 | 4/1985 | Andreasen | 362/306 |
| 4,928,209 | 5/1990 | Rodin | 362/217 |
| 5,257,762 | 11/1993 | Trame et al. | 248/50 |
| 5,368,495 | 11/1994 | Raby, Sr. et al. | 362/217 |

FOREIGN PATENT DOCUMENTS

| | | | |
|---|---|---|---|
| 1401899 | 4/1965 | France | 248/74.2 |

*Primary Examiner*—Ira S. Lazarus
*Assistant Examiner*—Alan B. Cariaso
*Attorney, Agent, or Firm*—William E. Meyer

[57] ABSTRACT

A miniature discharge lamp tube holder having clamp, and stake is disclosed. The miniature discharge lamp tube holder snaps to the mid section of a small diameter discharge lamp, and has a stake end that may be inserted into a formed hole in the lamp housing, or may be pressed directly, or with the help of heat, into the body of the lamp housing to thereby securely couple to the lamp housing, and securely clam to the lamp housing. The one piece support is easily installed, and still accurately holds the lamp. The support allows easy insertion and removal of the lamp, acts to dampen lamp vibration, and allows the tube to slide axially during thermal expansion and contraction. The support also minimizes the dark spot caused while holding the lamp, and minimally interferes with projected light.

2 Claims, 2 Drawing Sheets

MINIATURE DISCHARGE LAMP TUBE HOLDER

TECHNICAL FIELD

The invention relates to electric lamps and particularly to holders for electric lamps. More particularly the invention is concerned with a clamp for a miniature gas discharge lamp.

BACKGROUND ART

Miniature and subminiature gas discharge lamps are being made for a variety of purposes. One use in particular is as a vehicle stop lamp, where a 5 millimeter tube of neon is used as a taillight, or stop warning lamp. Some of these lamps are being made in rather long lengths. One lamp being considered is 122 centimeters (48 inch) long by 5 millimeters (0.2 inch) outside diameter. Discharge lamps generally offer excellent service in a vehicle, because there is no filament to bounce, stretch or break. Unfortunately, the long thin tubes flex and bend themselves. In longer lamps the tube may sway sufficiently to cause the lamp to separate from its connecting supports, or even fracture on a hard enough blow. There is then a need for a support along the length of the tube.

A support for a gas discharge lamp acts as a heat sink for the lamp. The result is a dark spot along the discharge. There is then a need for a lamp support that minimally affects lamp operation. A lamp heats up when lit, and therefore thermally expands. There is a need for a lamp support that tolerates thermal expansion and contraction. A lamp may fail and thereby need to be removed. There is then a need for a lamp support that tolerates of lamp insertion and removal. A vehicle lamp must endure substantial and frequent vibration and impact. There is then a need for a lamp support to assist this. A lamp intended for location in a reflector, should be accurately retained with respect to the reflector. There is then a need for a lamp support that holds a lamp in proper position accurately, particularly with reference to any focal point.

DISCLOSURE OF THE INVENTION

A miniature discharge lamp tube holder may be formed from a resilient clamp having at least three contact points arrayed to contact the surface of a tube, and thereby hold the tube in position, and a stake, coupled the clamp, having an extended length insertably connectable to an element of a lamp housing. In one embodiment, a simple twisted spring wire has been found to provide the important features.

BEST MODE FOR CARRYING OUT THE INVENTION

Figure 1:
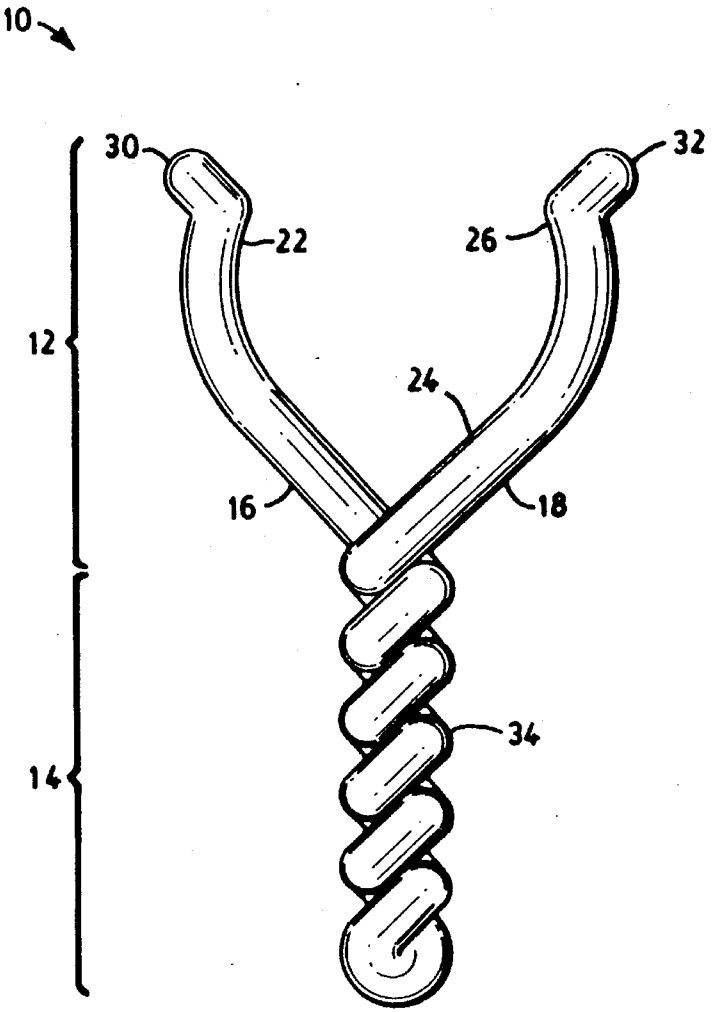
FIG. 1 shows an elevational view of a preferred embodiment of a miniature discharge lamp tube holder.

FIG. 1 shows a preferred embodiment of a miniature discharge lamp tube holder 10. Like reference numbers designate like or corresponding parts throughout the drawings and specification. The miniature discharge lamp tube holder 10 is assembled from a clamp 12, and a stake 14.

The clamp 12 may be made out of a resilient material, such as plastic or metal to have the general form of a yoke with two arms 16, 18. The clamp 12 has at least three contact points arrayed to contact the surface of the lamp tube 20. The contact points should be positioned to constrain the motion of the lamp tube 20, such as by forming a triangle whose greatest angle is ninety or fewer degrees. Three suggest contact points 22, 24, and 26 are shown in the drawing; however, it should be understood that the actual contact points are likely to vary around the inside of the yoke arms, depending on manufacturing. The roughly equal angular spreading of contacts, positions the contact points around the lamp tube 20 so there is at least one contact point on either side of any diameter through the lamp tube 20. These limitations are set out in expectation that the lamp tube 20 is a circular cylinder. Other configurations may be used for other tube 20 shapes.

In essence the contact points form a trap that the lamp tube 20 may be pressed into and retained by. By spreading the resilient arms 16, 18, the lamp tube 20 fits into the clamp 12, and is captured in place as the resilient arms 16, 18 spring back, partially surrounding the tube 20. It was found that as the ends of the arms 16, 18 reach farther around the lamp, a large dark spot, due to the cooling effect of the arms, appeared in the lamp. Where the arms 16, 18 reached only somewhat beyond 180 degrees of the lamp circumference, there was little or no dark spot. This is then the preferred design.

The stake 14 may be made out of any sufficiently rigid material to hold the clamp 12 in position relative to a lamp housing 28. The clamp 12 may be coupled to the stake 14, but in the preferred embodiment, the two are formed as a single piece of the same plastic or metal. The preferred stake 14 is shaped to have the general form of a rod, that may have prominences or indentations that help bind the stake 14 to the lamp housing 28 where the stake 14 is inserted. Preferably the stake is melt fused into the plastic body of a lamp reflector or the lamp housing. Alternatively, the stake 14 is pressed or screwed into a hole formed in the reflector or lamp housing.

In the preferred embodiment, the holder 10 is formed from stiff wire twisted in the shape of a Y. The resilient arms 16, 18 of the Y are generally shaped to be spread and snap fitted around the lamp tube 20. The arms 16, 18 may have rolled back, or rounded ends 30, 32 to avoid sharp edged contact that might scratch the glass lamp tube 20 during insertion. A scratched lamp is subject to premature failure. The arms 16, 18 may be single wire sections or double wire sections that snap around the body of the lamp. The arms 16, 18 should have a sufficiently high spring constant to hold the tube 20 securely during expected operating conditions.

Figure 2:
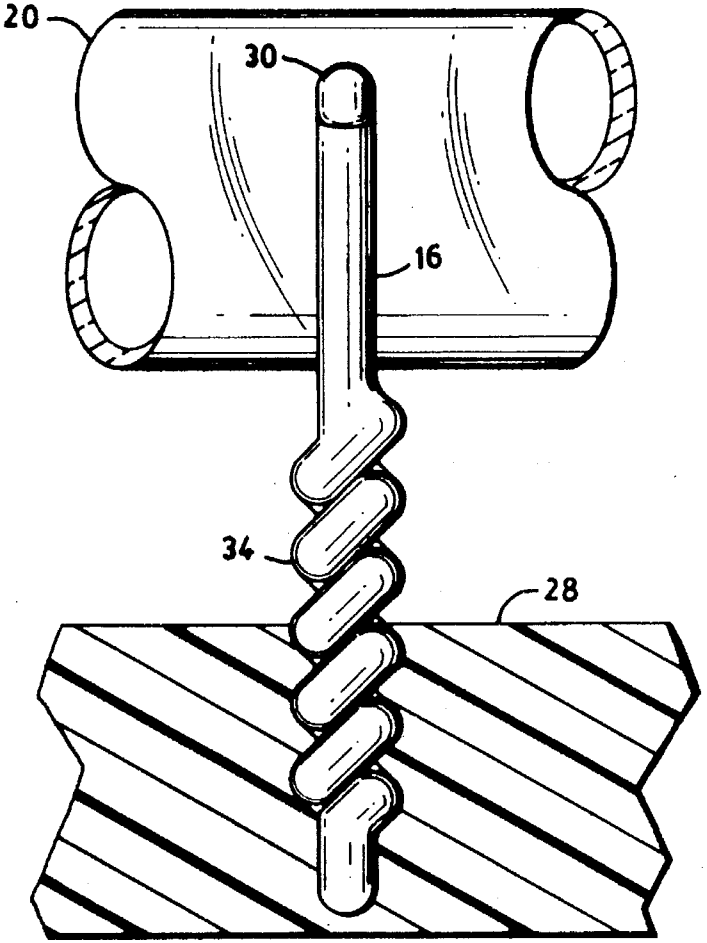
FIG. 2 shows a side elevational view of a preferred lamp tube holder with the lamp tube, and lamp reflector partially broken away.

The base of the Y provides the stake 14 and is formed as a double wire spiral 34 that may be inserted or pressed into a hole in a reflector, or a wall of the lamp housing 28. The double wire spiral 34 is sufficiently stronger than the arms 16, 18 to effectively be rigid. In particular, where the reflector, or lamp housing 28 is made of plastic, the double wire spiral 34 can be heated and pressed directly into the plastic lamp housing 28. The plastic then hardens in the spiral indentations, locking the double wire spiral 34 (stake 14) and reflector or lamp housing 28 one to the other. Alternatively, the double wire spiral 34 may be screwed into a hole formed in the reflector or lamp housing 28, treating the double wire spiral 34 as a threaded item. FIG. 2 shows a side elevational view of a preferred lamp tube holder 10 with the lamp tube 20, and lamp reflector or housing 28 partially broken away.

Figure 4:
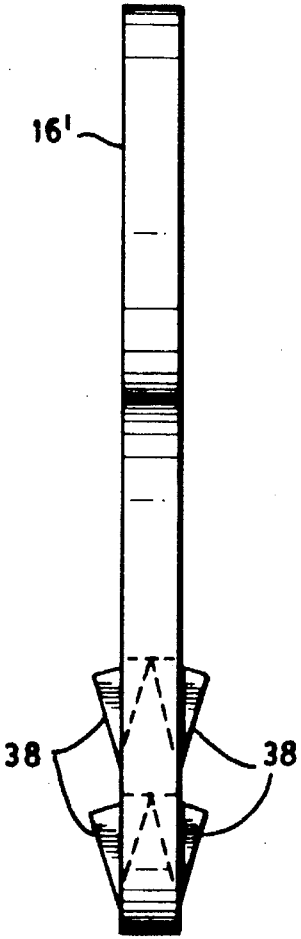
FIG. 4 shows a side elevational view of the alternative lamp tube holder.
Figure 3:
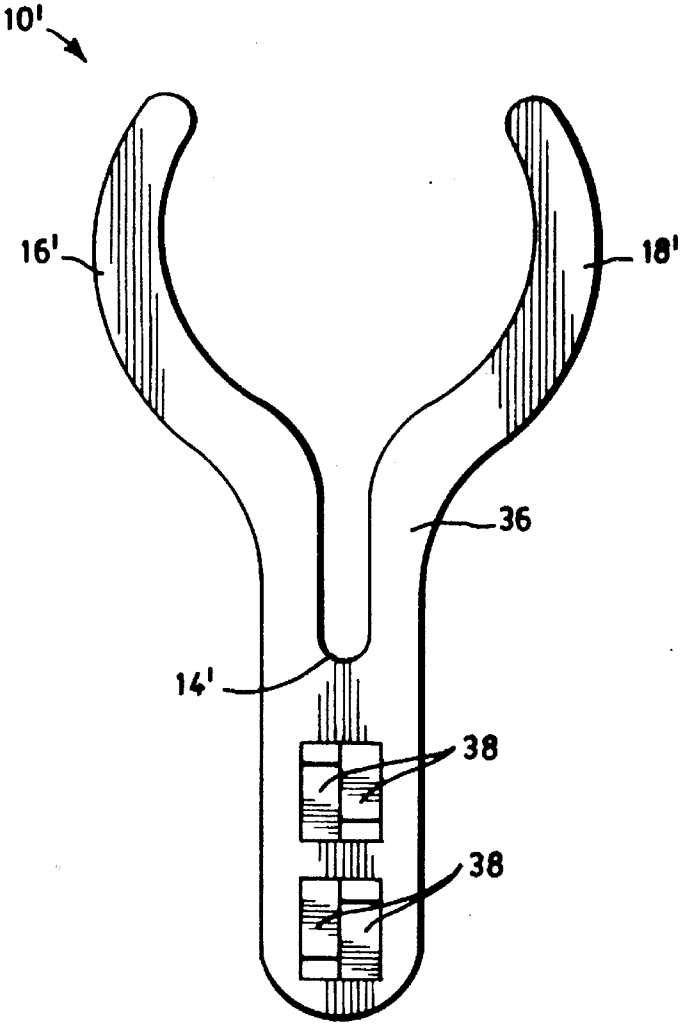
FIG. 3 shows an elevational view of an alternative embodiment of a lamp tube holder.

In an alternative form, the holder 10' may be made as a single piece of flat plastic or metal. This piece may be molded or stamped as a single piece in the shape of a Y. The Y may be formed with a deep slot 36 formed between the arms of the Y. The slot 36 provides enhanced flexibility to the arms of a stamped or molded piece. Barb 38 may be a wedge shaped projection from the holder formed along the base of the holder. The stake then includes a barb to bind with a lamp housing when the stake is insertably connected thereto. The barbs 38 help fix the stake 14' to a reflector or lamp housing. The holder 10' has arms 16', 18' that may be shaped as a circular section with 180 or more degrees of section. FIG. 3 shows an elevational view of an alternative embodiment of a lamp tube holder. FIG. 4 shows a side elevational view of the alternative lamp tube holder.

A miniature gas discharge lamp holder 10 was made from wire with a nominal diameter of 0.762 millimeters (0.03 inches) but this could be varied from 0.254 to 1.524 millimeters (0.01 to 0.06 inches) diameter wire. Stainless steel or plated music wire is suggested. The wire was twisted in the middle to form double wire spiral 7.87 millimeters long (0.31 inch). The free ends of the wire were then bent to form a yoke with resilient arms 16, 18 forming a circular section of approximately 270 degrees (unoccupied by the lamp tube). The circular section had a diameter of about 6.93 millimeters (0.27 inch), and snap fit to a 5.0 millimeter diameter miniature gas discharge lamp tube. The double wire spiral base of the Y was heated and pressed into a plastic reflector to about one half of the depth of the base. The spiral base may be heated by flames, laser or radio function heating. The heat staking process should be executed carefully to not under or over heat the base, and thereby injury the lamp housing or make accurate positioning of the yoke difficult. When the melted plastic hardened, the yoke was firmly anchored in place and accurately held the center portion of an elongated miniature gas discharge lamp tube.

When spread around the lamp tube, the yoke provided about a one pound clamping force on the lamp. This was sufficient to hold the lamp during vibration and impact testing. Nonetheless, the clamping still allowed the lamp to slide axially during thermal expansions and contractions of the lamp and housing. The arms 16, 18 of the yoke then have minimal contact with the lamp, and thereby created only small, or even no cold spots along the lamp. The yoke, with the open Y portions facing up, (in the direction of illumination), minimally blocked the projected light. Little or no shadow was formed in the up (illumination) direction.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A miniature, holder for coupling a discharge lamp tube to a wall of a plastic housing comprising:

a single piece having a resilient clamp portion formed from a wire, having at least three contact points arrayed to contact the surface of a gas discharge tube, and thereby hold the tube in position, and a stake portion formed as spiraled wire, having an extended length insertably connectable by fusion to the wall of the plastic lamp housing to provide fixed support of the clamp.

2. The holder in claim 1, wherein the clamp portion has a curved end to avoid sharp edged contact with the tube.

* * * * *